US009072144B2

(12) United States Patent
Tsai et al.

(10) Patent No.: US 9,072,144 B2
(45) Date of Patent: Jun. 30, 2015

(54) CONTROL DEVICE AND LIGHT SOURCE DEVICE

(71) Applicants: INVENTEC (PUDONG) TECHNOLOGY CORPORATION, Shanghai (CN); INVENTEC CORPORATION, Taipei (TW)

(72) Inventors: Sheng-Yuan Tsai, Taipei (TW); Chin-Hsien Yeh, Taipei (TW)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 349 days.

(21) Appl. No.: 13/830,229

(22) Filed: Mar. 14, 2013

(65) Prior Publication Data

US 2014/0139105 A1 May 22, 2014

(30) Foreign Application Priority Data

Nov. 16, 2012 (CN) ..... 2012 1 0464153

(51) Int. Cl.
*H01K 1/62* (2006.01)
*H05B 33/08* (2006.01)

(52) U.S. Cl.
CPC ..... *H05B 33/0827* (2013.01)

(58) Field of Classification Search
CPC ..... H01K 1/62; H05B 33/0827
USPC ..... 315/51, 121, 130
See application file for complete search history.

(56) References Cited

U.S. PATENT DOCUMENTS 8,247,975 B2 * 8/2012 Yoo et al. ..... 315/51

* cited by examiner

*Primary Examiner* — Hai L Nguyen
(74) *Attorney, Agent, or Firm* — Huffman Law Group, PC

(57) ABSTRACT

A control device adapted to control a first light-emitting diode and a second light-emitting diode, includes a first logic operation unit receiving a first enable signal and a second enable signal to generate a first logic signal, a second logic operation unit receiving the first and second enable signals to generate a second logic signal, a first adjustment unit generating a first adjustment signal according to the first logic signal, a second adjustment unit generating a second adjustment signal according to the second logic signal, a first control unit outputting a first control signal to the first light-emitting diode according to the first enable signal and the first adjustment signal, and a second control unit outputting a second control signal to the second light-emitting diode according to the second enable signal and the second adjustment signal. The first logic signal and the second logic signal are complementary.

20 Claims, 3 Drawing Sheets

CONTROL DEVICE AND LIGHT SOURCE DEVICE

CROSS-REFERENCE TO RELATED APPLICATIONS

This non-provisional application claims priority under 35 U.S.C. §119(a) on Patent Application No(s). 201210464153.2 filed in China on Nov. 16, 2012, the entire contents of which are hereby incorporated by reference.

TECHNICAL FIELD

This disclosure relates to a control device, in particular to a control device adapted to a light-emitting diode and a light source device.

RELATED ART

FIG. 1 is a schematic diagram of a general light source device. For the light source device 100, the light-emitting diodes 130 (e.g. a red light-emitting diode) and 140 (e.g. a green light-emitting diode) are respectively connected in series with the resistors 110 and 120, to adjust the current passing through the light-emitting diodes 130 and 140, thereby controlling the brightness of light emitted by the light emitting diodes 130 and 140.

The brightness of the light-emitting diodes 130 and 140 is constant after the resistors 110 and 120 are disposed in the light source device 100, so that the mixed brightness and colors associating with the light-emitting diodes 130 and 140 are also constant in a light mixing application. Thus, the light source device 100 cannot control the mixed brightness and color of the mixed light.

To adjust the mixed brightness and color of the mixed light, the resistors 110 and 120 should be replaced to change the resistance value, so as to adjust the current passing through the light-emitting diodes 130 and 140. Thus, the light source device 100 can emit light having an appropriate mixed brightness and color. However, the means of replacing the resistors 110 and 120 also affects the intrinsic brightness of light emitted by the light-emitting diodes 130 and 140.

SUMMARY

The disclosure relates to a control device adapted to control a first light-emitting diode and a second light-emitting diode. The control device includes a first logic operation unit, a first adjustment unit, a first control unit, a second logic operation unit, a second adjustment unit, and a second control unit. The first logic operation unit is used for receiving a first enable signal and a second enable signal to generate a first logic signal. The first adjustment unit is coupled with the first logic operation unit for receiving the first logic signal and generating a first adjustment signal according to the first logic signal. The first control unit is coupled with the first adjustment unit for receiving the first enable signal and the first adjustment signal, and outputting a first control signal to the first light-emitting diode according to the first enable signal and the first adjustment signal. The second logic operation unit is used for receiving the first enable signal and the second enable signal, to generate a second logic signal, wherein the first and second logic signals are complementary. The second adjustment unit is coupled with the second logic operation unit for receiving the second logic signal, and generating a second adjustment signal according to the second logic signal. The second control unit is coupled with the second adjustment unit for receiving the second enable signal and the second adjustment signal, and outputting a second control signal to the second light-emitting diode according to the second enable signal and the second adjustment signal.

In one embodiment, the first logic operation unit is an AND gate, and the second logic operation unit is a NAND gate.

In one embodiment, the first adjustment unit includes a first transistor, a first resistor, a second resistor and a first diode. The first transistor has a first end, a second end and a third end, wherein the first end receives the first logic signal, and the second end generates the first adjustment signal. The first resistor has a first end coupled with the second end of the first transistor, and a second end coupled with a ground terminal. The second resistor has a first end coupled with the third end of the first transistor, and a second end coupled with the ground terminal. The first diode has an anode terminal coupled with the third end of the first transistor, and a cathode terminal coupled with the second end of the first transistor.

In one embodiment, the second adjustment unit includes a second transistor, a third resistor, a fourth resistor and a second diode. The second transistor has a first end, a second end and a third end, wherein the first end receives the second logic signal, and the second end generates the second adjustment signal. The third resistor has a first end coupled with the second end of the second transistor, and a second end coupled with the ground terminal. The fourth resistor has a first end coupled with the third end of the second transistor, and a second end coupled with the ground terminal. The second diode has an anode terminal coupled with the third end of the second transistor, and a cathode terminal coupled with the second end of the second transistor.

Characterized another way, the disclosure relates to a light source device which includes a first logic operation unit, a first adjustment unit, a first control unit, a first light-emitting diode, a second logic operation unit, a second adjustment unit, a second control unit, and a second light-emitting diode. The first logic operation unit is used for receiving a first enable signal and a second enable signal to generate a first logic signal. The first adjustment unit is coupled with the first logic operation unit for receiving the first logic signal, and generating a first adjustment signal according to the first logic signal. The first control unit is coupled with the first adjustment unit for receiving the first enable signal and the first adjustment signal, and generating a first control signal according to the first enable signal and the first adjustment signal. The first light-emitting diode has an anode terminal for receiving an operating voltage, and a cathode terminal for receiving a first control signal. The second logic operation unit is used for receiving the first enable signal and the second enable signal to generate a second logic signal, wherein the first and second logic signals are complementary. The second adjustment unit is coupled with the second logic operation unit for receiving the second logic signal and generating a second adjustment signal according to the second logic signal. The second control unit is coupled with the second adjustment unit for receiving the second enable signal and the second adjustment signal, and generating a second control signal according to the second enable signal and the second adjustment signal. The second light-emitting diode has an anode terminal for receiving the operating voltage, and a cathode terminal for receiving the second control signal.

In one embodiment, the first logic operation unit is an AND gate, and the second logic operation unit is a NAND gate.

In one embodiment, the first adjustment unit includes a first transistor, a first resistor, a second resistor and a first diode. The first transistor has a first end, a second end and a third end, wherein the first end receives the first logic signal, and the second end generates the first adjustment signal. The first resistor has a first end coupled with the second end of the first transistor, and a second end coupled with a ground terminal. The second resistor has a first end coupled with the third end of the first transistor, and a second end coupled with the ground terminal. The first diode has an anode terminal coupled with the third end of the first transistor, and a cathode terminal coupled with the second end of the first transistor.

In one embodiment, the second adjustment unit includes a second transistor, a third resistor, a fourth resistor and a second diode. The second transistor has a first end, a second end and a third end, wherein the first end receives the second logic signal, and the second end generates the second adjustment signal. The third resistor has a first end coupled with the second end of the second transistor, and a second end coupled with the ground terminal. The fourth resistor has a first end coupled with the third end of the second transistor, and a second end coupled with the ground terminal. The second diode has an anode terminal coupled with the third end of the second transistor, and a cathode terminal coupled with the second end of the second transistor.

Characterized yet another way, a light brightness and mixing control logic for two light emitting diodes (LEDs) comprises a pair of enable signal lines coupled to resistor circuits that are operative to provide selectable resistance values to control the brightness of the LEDs. Each line carries either a first logic value or a second logic value. The first logic value is operative to enable a corresponding one of the two LEDs to emit light, and the second logic value is operative to disable the corresponding LED from emitting light. When neither signal line carries the first logic value, neither LED is operative to emit light. When both signal lines carry the first logic value, both LEDs are operative to emit light, each in accordance with a corresponding first selected resistance value. When only one of the signal lines carries the first logic value, only the corresponding LED is operative to emit light, and in accordance with a corresponding second selected resistance value.

BRIEF DESCRIPTION OF THE DRAWINGS

The present disclosure will become more fully understood from the detailed description given herein below for illustration only, and thus does not limit the present disclosure, wherein.

DETAILED DESCRIPTION

In following embodiments, the same or similar components are represented by the same label.

Figure 2:
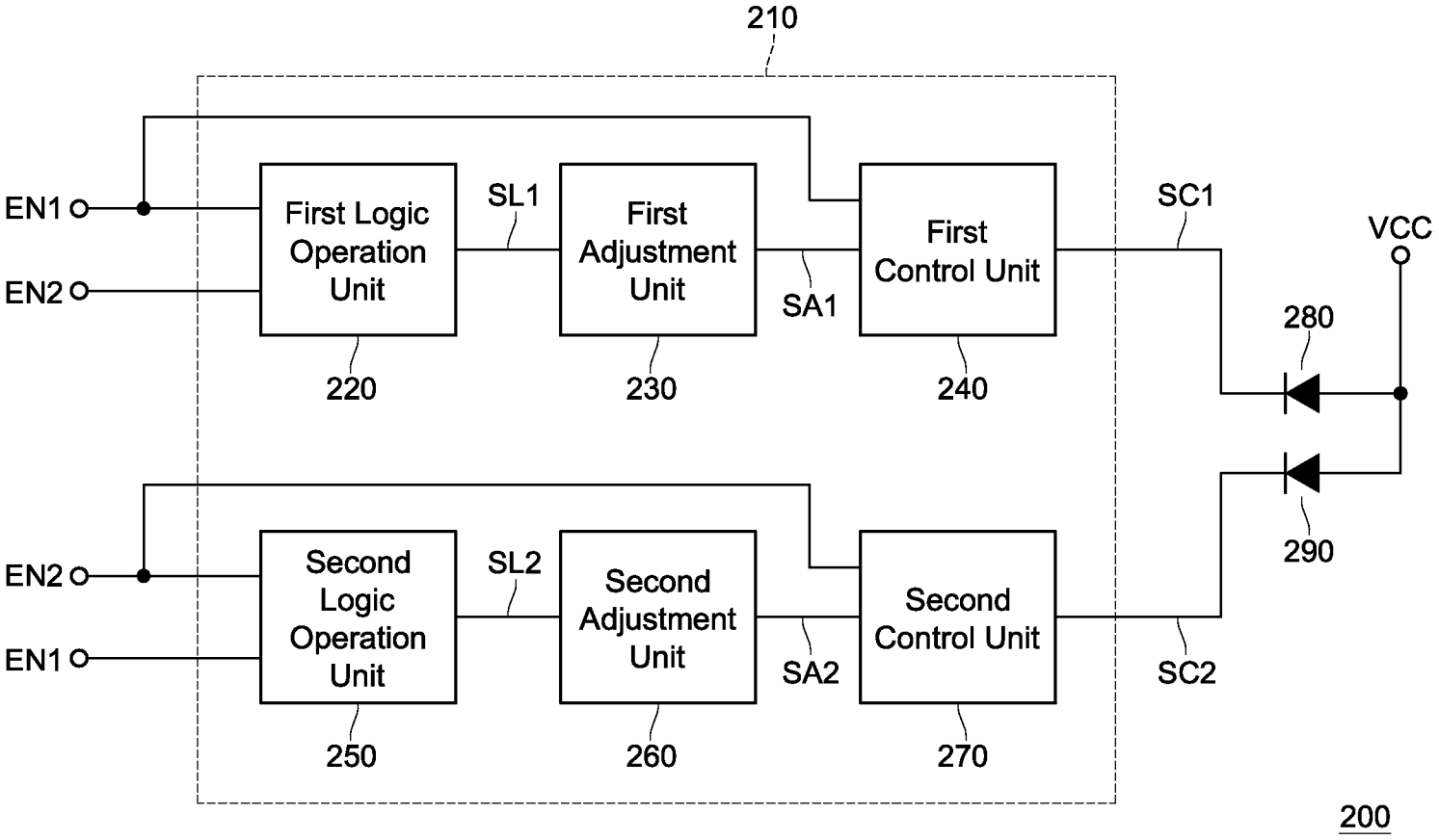
FIG. 2 is a schematic diagram of the light source device of this disclosure.

FIG. 2 is a schematic drawing for the light source device of this disclosure. The light source device 200 includes a control device 210, a first light-emitting diode 280 and a second light-emitting diode 290. The control device 210 also includes a first logic operation unit 220, a first adjustment unit 230, a first control unit 240, a second logic operation unit 250, a second adjustment unit 260, and a second control unit 270.

The first logic operation unit 220 is used for receiving a first enable signal EN1 and a second enable signal EN2 to generate a first logic signal SL1. For example, when at least one of the first enable signal EN1 and the second enable signal EN2 is at the low logic level, the first logic signal SL1, for example, is at the low logic level. When both the first enable signal EN1 and the second enable signal EN2 are at the high logic level, the first logic signal SL1, for example, is at the high logic level.

The first adjustment unit 230 is coupled with the first logic operation unit 220, for receiving the first logic signal SL1 and generating a first adjustment signal SA1 according to the first logic signal. In this embodiment, the first adjustment unit 230 adjusts a resistance value according to, for example, the logic level of the first logic signal SL1, so as to generate the first adjustment signal SA1 corresponding to the resistance value.

For example, when the first logic signal SL1 is at the high logic level, the first adjustment unit 230 generates the first adjustment signal SA1 corresponding to a first resistance value; otherwise, the first adjustment unit 230 generates the first adjustment signal SA1 corresponding to a second resistance value. The first resistance value, for example, is greater than the second resistance value.

The first control unit 240 is coupled with the first adjustment unit 230, for receiving the first enable signal EN1 and the first adjustment signal SA1, and generating a first control signal SC1 according to the first enable signal EN1 and the first adjustment signal SC1.

For example, when the first enable signal EN1 is at the low logic level, the first control unit 240 generates the first control signal SC1 at the high logic level; otherwise, the first control unit 240 generates the first control signal SC1 corresponding to the resistance value, e.g. the first or second resistance value, corresponding to the first adjustment signal SA1, so as to control the current passing through the first light-emitting diode 280.

The second logic operation unit 250 is used for receiving the first enable signal EN1 and the second enable signal EN2 to generate a second logic signal SL2. For example, when at least one of the first enable signal EN1 and the second enable signal EN2 is at the low logic level, the second logic signal SL2 is at the low logic level. In contrast, when both the first enable signal EN1 and the second enable signal EN2 are at the high logic level, the second logic signal SL2 is at the high logic level.

Furthermore, the first logic signal SL1 and the second logic signal SL2 are complementary to each other. In other words, while the first logic signal SL1 is at the high logic level, the second logic signal SL2 is at the low logic level, and while the first logic signal SL1 is at the low logic level, the second logic signal SL2 is at the high logic level.

The second adjustment unit 260 is coupled with the second logic operation unit 250, for receiving the second logic signal SL2, and generating a second adjustment signal SA2 according to the second logic signal. In this embodiment, the second adjustment unit 260 adjusts a resistance value according to, for example, the logic level of the second logic signal SL2, to generate the second adjustment signal SA2 corresponding to the resistance value.

For example, when the second logic signal SL2 is at the high logic level, the second adjustment unit 260 generates the second adjustment signal SA2 corresponding to a third resistance value; and when the second logic signal SL2 is at the low logic level, the second adjustment unit 260 generates the second adjustment signal SA2 corresponding to a fourth resistance value. The third resistance value, for example, is greater than the fourth resistance value.

The second control unit 270 is coupled with the second adjustment unit 260, for receiving the second enable signal EN2 and the second adjustment signal SA2, and generating a second control signal SC2 according to the second enable signal EN2 and the second adjustment signal SA2.

For example, when the second enable signal EN2 is at the low logic level, the second control unit 270 generates the second control signal SC2 at the high logic level. When the second enable signal EN2 is at the high logic level, the second control unit 270 generates the second control signal SC2 corresponding to the resistance value, e.g. the third or fourth resistance value, which corresponds to the second adjustment signal SA2, so as to control the current passing through the second light-emitting diode 290.

The first light-emitting diode 280 has an anode terminal receiving an operating voltage VCC, e.g. P3V3_STBY, and a cathode terminal receiving a first control signal SC1. For example, when the first control signal SC1 is at the high logic level, the first light-emitting diode 280 is turned off and does not emit light. When the first control signal SC1 corresponds to the first resistance value, the first light-emitting diode 280 is turned on and emits light with the first brightness. When the first control signal SC1 corresponds to the second resistance value, the first light-emitting diode 280 is turned on and emits light with the second brightness. The first brightness is smaller than the second brightness.

The second light-emitting diode 290 has an anode terminal receiving an operating voltage VCC, e.g. P3V3_STBY, and a cathode terminal receiving a second control signal SC2. For example, when the second control signal SC2 is at the high logic level, the second light-emitting diode 290 is turned off and does not emit light. When the second control signal SC2 corresponds to the third resistance value, the second light-emitting diode 290 is turned on and emits light with the third brightness. When the second control signal SC2 corresponds to the fourth resistance value, the second light-emitting diode 290 is turned on and emits light with the fourth brightness. The fourth brightness is less than the third brightness.

According to the above description, when being individually turned on, the first light-emitting diode 280 emits light having the first brightness. Similarly, when being individually turned on, the second light-emitting diode 290 emits light having the third brightness. When the first light-emitting diode 280 and the second light-emitting diode 290 are turned on simultaneously, the first light-emitting diode 280 emits light having the second brightness, and the second light-emitting diode 290 emits light having the fourth brightness, so as to form the mixed light having an appropriate brightness.

In this way, it is unnecessary to replace resistors when light-emitting diodes emit light separately or when a light mixing is performed, so that the brightness of light-emitting diodes may not be affected. This effectively makes it easier to control the light emitting and light mixing of light emitting diodes.

Figure 1:
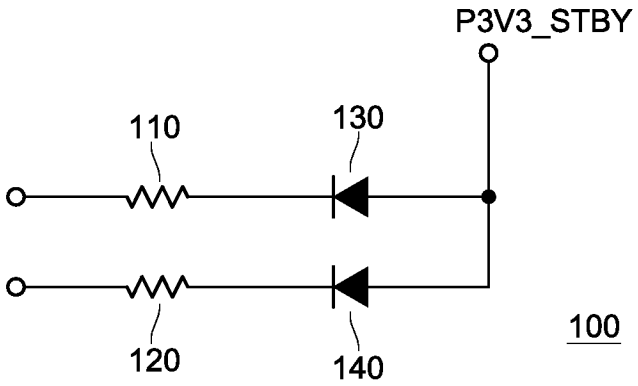
FIG. 1 is a schematic diagram for a general light source device.
Figure 3:
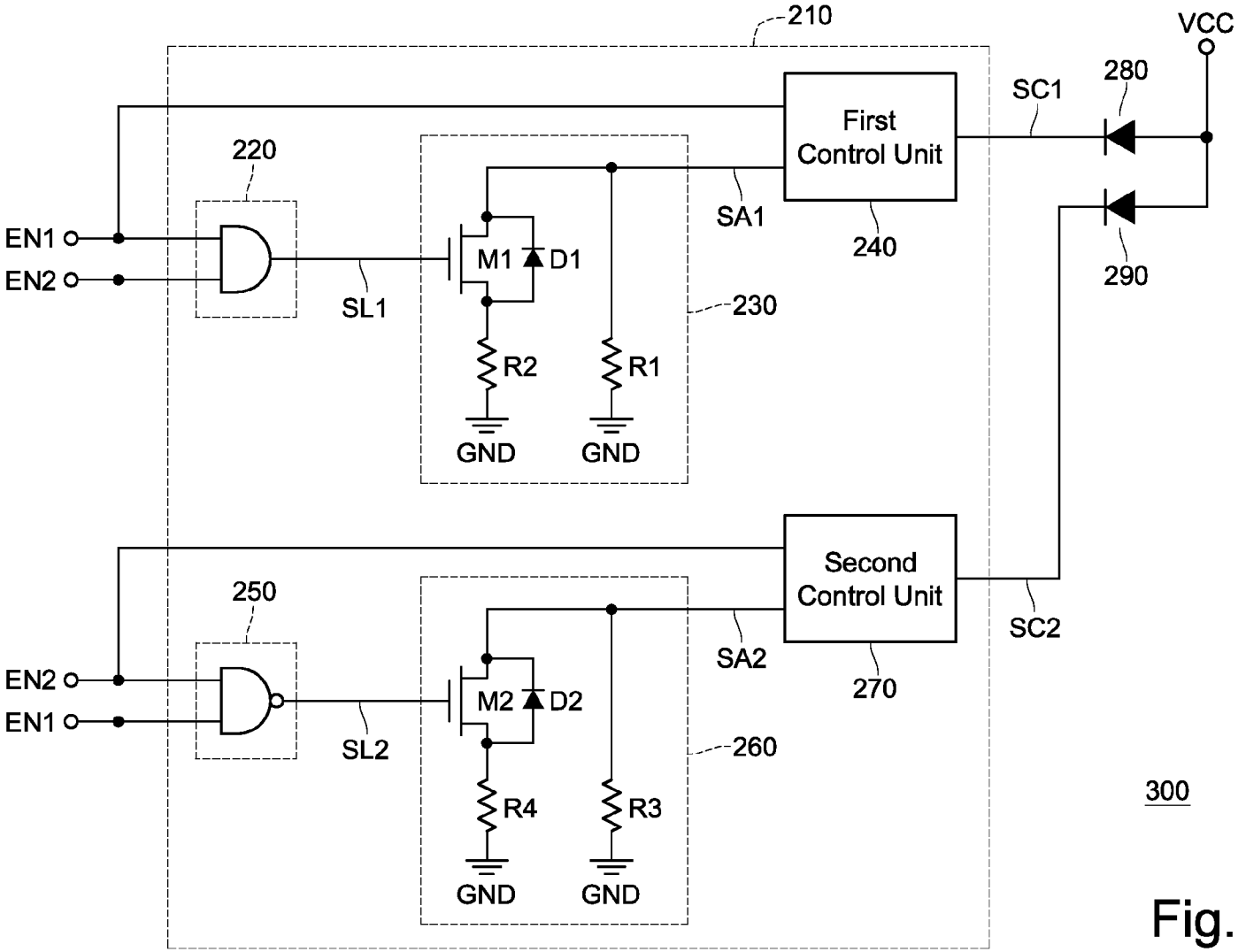
FIG. 3 is a detailed schematic of the light source device of this disclosure.

Refer to FIG. 3, a detailed schematic diagram of the light source device of this disclosure. The light source device 300 includes a drive device 210, a first light-emitting diode 280 and a second light-emitting diode 290. The drive device 210 includes a first logic operation unit 220, a first adjustment unit 230, a first control unit 240, a second logic operation unit 250, a second adjustment unit 260, and a second control unit 270. The coupling relations and relevant operations for the first logic operation unit 220, the first adjustment unit 230, the first control unit 240, the second logic operation unit 250, the second adjustment unit 260, the second control unit 270, the first light-emitting diode 280 and the second light-emitting diode 290 can refer to the descriptions of FIG. 1, so it will not be described repeatedly here.

In this embodiment, the first logic operation unit 220, for example, is an AND gate, and the second logic operation unit 250, for example, is a NAND gate, so that the first and second logic signals are complementary to each other.

For example, when at least one of the first enable signal EN1 and the second enable signal EN2 is at the low logic level, the first logic signal SL1 generated by the first logic operation unit 220 is at the low logic level, and the second logic signal SL2 generated by the second logic operation unit 250 is at the high logic level. When both the first enable signal EN1 and the second enable signal EN2 are at the high logic level, the first logic signal SL1 generated by the first logic operation unit 220 is at the high logic level, and the second logic signal SL2 generated by the second logic operation unit 250 is at the low logic level.

The first adjustment unit 230 includes a first transistor M1, a first resistor R1, a second resistor R2 and a first light-emitting diode D1. The first transistor M1 has a first end, a second end and a third end, wherein the first end receives the first logic signal SL1, and the second end generates the first adjustment signal SA1.

In this embodiment, the first transistor M1, for example, is a N-type transistor. For example, the first end of the first transistor M1 is a gate terminal, the second end of the first transistor M1 is the drain terminal, and the third end of the first transistor M1 is a source terminal. In another embodiment, the first transistor M1 can also be a P-type transistor or other types of transistors.

The first resistor R1 has a first end coupled with the second end of the first transistor M1, and a second end coupled with a ground terminal GND. The second resistor R2 has a first end coupled with the third end of the first transistor M1, and a second end coupled with the ground terminal GND. The first diode D1 has an anode terminal coupled with the third end of the first transistor M1, and a cathode terminal coupled with the second end of the first transistor M1. The first diode D1 is used for clamping the voltage between the second end and the third end of the first transistor M1.

The second adjustment unit 260 includes a second transistor M2, a third resistor R3, a fourth resistor R4 and a second light-emitting diode D2. The second transistor M2 has a first end, a second end and a third end, wherein the first end receives the second logic signal SL2, and the second end generates the second adjustment signal SA2.

In this embodiment, the second transistor M2, for example, is a N-type transistor, wherein the first end of the second transistor M2 is a gate terminal of the N-type transistor, the second end of the second transistor M2 is a drain terminal of the N-type transistor, and the third end of the second transistor M2 is a source terminal of the N-type transistor. In another embodiment, the second transistor M2 can also be a P-type transistor or other types of transistors.

The third resistor R3 has a first end coupled with the second end of the second transistor M2, and a second end coupled with the ground terminal GND. The fourth resistor R4 has a first end coupled with the third end of the second transistor M2, and a second end coupled with the ground terminal GND. The second diode D2 has an anode terminal coupled with the third end of the second transistor M2, and a cathode terminal coupled with the second end of the second transistor M2. The second diode D2 is used for clamping the voltage between the second end and the third end of the second transistor M2.

The operation of the light source device 300 is described as follows.

Firstly, when the first enable signal EN1 is at the high logic level and the second enable signal EN2 at the low logic level, the first logic operation unit 220 outputs the first logic signal SL1 at the low logic level to the first end of the first transistor M1, and the second logic operation unit 250 outputs the second logic signal SL2 at the high logic level to the first end of the second transistor M2.

Then, the first transistor M1 is turned off, and the first adjustment unit 230 takes the resistance value of the first resistor R1 as the first resistance value to output the first adjustment signal SA1 corresponding to the first resistance value, to the first control unit 240. Meanwhile, the second transistor M2 is turned on, so that the third resistor R3 and the fourth resistor R4 are coupled in parallel. Herein, the second adjustment unit 260 takes the resistance value formed by the third resistor R3 and the fourth resistor R4 which are coupled to each other in parallel, as the third resistance value to output the second adjustment signal SA2 corresponding to the third resistance value, to the second control unit 270.

Subsequently, the first control unit 240 outputs the first control signal SC1 corresponding to the first resistance value to the first light-emitting diode 280 according to the first enable signal EN1 at the high logic level and the first adjustment signal SA1 corresponding to the first resistance value. Thus, the first light-emitting diode 280 is turned on and emits light having the first brightness. On the other hand, the second control unit 270 outputs the second control signal SC2 at the high logic level to the second light-emitting diode 290 according to the second enable signal EN2 at the low logic level, so that the second light-emitting diode 290 is turned off and does not emit. In this way, when the first light-emitting diode 280 is turned on individually, an appropriate brightness corresponding to the first resistance value can be achieved.

In addition, when the first enable signal EN1 is at the low logic level and the second enable signal EN2 at the high logic level, the first logic operation unit 220 outputs the first logic signal SL1 at the low logic level to the first end of the first transistor M1, and the second logic operation unit 250 outputs the second logic signal SL2 at the high logic level to the first end of the second transistor M2.

Then, the first transistor M1 is turned off, so that the first adjustment unit 230 takes the resistance value of the first resistor R1 as the first resistance value to output the first adjustment signal SA1 corresponding to the first resistance value, to the first control unit 240. Meanwhile, the second transistor M2 is turned on, so that the third resistor R3 and the fourth resistor R4 are coupled in parallel. Herein, the second adjustment unit 260 takes the resistance value formed by the parallel third resistor R3 and fourth resistor R4 which are coupled in parallel, as the third resistance value to output the second adjustment signal SA2 corresponding to the third resistance value, to the second control unit 270.

Subsequently, the first control unit 240 outputs the first control signal SC1 at the high logic level to the first light-emitting diode 280 according to the first enable signal EN1 at the low logic level, so that the first light-emitting diode 280 is turned off and does not emit. On the other hand, the second control unit 270 outputs the second control signal SC2 corresponding to the third resistance value to the second light-emitting diode 290 according to the second enable signal EN2 at the high logic level and the second adjustment signal SA2 corresponding to the third resistance value. Thus, the second light-emitting diode 290 is turned on and emits light having the third brightness. In this way, when the second light-emitting diode 290 is turned on individually, an appropriate brightness corresponding to the third resistance value can be achieved.

Moreover, when both the first enable signal EN1 and the second enable signal EN2 are at the high logic level, the first logic operation unit 220 outputs the first logic signal SL1 at the high logic level to the first end of the first transistor M1, and the second logic operation unit 250 outputs the second logic signal SL2 at the low logic level to the first end of the second transistor M2.

Then, the first transistor M1 is turned on, so that the first resistor R1 and the second resistor R2 are coupled in parallel. Herein, the first adjustment unit 230 takes the resistance value formed by the coupled first and second resistors R1 and R2, as the second resistance value to output the first adjustment signal SA1 corresponding to the second resistance value, to the first control unit 240. Meanwhile, the second transistor M2 is turned off, so that the second adjustment unit 260 takes the resistance value of the third resistor R3 as the fourth resistance value to output the second adjustment signal SA2 corresponding to the fourth resistance value, the second control unit 270.

Subsequently, the first control unit 240 outputs the first control signal SC1 corresponding to the second resistance value to the first light-emitting diode 280 according to the first enable signal EN1 at the high logic level and the first adjustment signal SA1 corresponding to the second resistance value. Thus, the first light-emitting diode 280 is turned on and emits light having the second brightness. On the other hand, the second control unit 270 outputs the second control signal SC2 corresponding to the fourth resistance value to the second light-emitting diode 290 according to the second enable signal EN2 at the high logic level and the second adjustment signal SA2 corresponding to the third resistance value. Thus, the second light-emitting diode 290 is turned on and emits light having the fourth brightness. In this way, when the first light-emitting diode 280 and the second light-emitting diode 290 are turned on simultaneously, an appropriate mixed brightness corresponding to the second and fourth resistance values can be achieved.

In this embodiment, the brightness for the first light-emitting diode 280 and for the second light-emitting diode 290 can be adjusted by adjusting the values of the first resistor R1, the second resistor R2, the third resistor R3 and the fourth resistor R4. Thus, the light source device can provide a proper brightness of light emitted by a single light-emitting diode, and a proper mixed brightness of light simultaneously emitted by two light-emitting diodes.

Additionally, the quantities of the first light-emitting diode 280 and the second light-emitting diode 290 in the above embodiments are just examples, but do not limit the disclosure. The quantities of the first light-emitting diode 280 and the second light-emitting diode 290 can also be two or more. The controlling of the first light-emitting diode 280 and the second light-emitting diode 290 can refer to the foregoing description, so it is not described repeatedly herein.

In the control device and the light source device in this disclosure, the first and second logic operation units generate the first and second logic signals complementary to each other, according to the first and second enable signals respectively; the first and second adjustment units generate the first and second adjustment signals according to the first and second logic signals respectively; the first control unit generates the first control signal according to the first enable signal and the first adjustment signal, to control the brightness of the first light-emitting diode; and the second control unit generates the second control signal according to the second enable signal and the second adjustment signal, to control the brightness of the second light-emitting diode. In this way, by adjust the brightness of the light-emitting diodes without replacing resistors, the disclosure may provide an appropriate brightness and an appropriate mixed brightness, thereby promoting the ease of use.

What is claimed is:

1. A control device, adapted to control a first light-emitting diode and a second light-emitting diode, and comprising:

a first logic operation unit, for receiving a first enable signal and a second enable signal to generate a first logic signal;

a first adjustment unit, coupled with the first logic operation unit, for receiving the first logic signal, and generating a first adjustment signal according to the first logic signal;

a first control unit, coupled with the first adjustment unit, for receiving the first enable signal and the first adjustment signal, and outputting a first control signal to the first light-emitting diode according to the first enable signal and the first adjustment signal;

a second logic operation unit, for receiving the first enable signal and the second enable signal to generate a second logic signal, wherein the first and second logic signals are complementary;

a second adjustment unit, coupled with the second logic operation unit, for receiving the second logic signal, and generating a second adjustment signal according to the second logic signal; and a second control unit, coupled with the second adjustment unit, for receiving the second enable signal and the second adjustment signal, and outputting a second control signal to the second light-emitting diode according to the second enable signal and the second adjustment signal.

2. The control device according to claim 1, wherein the first logic operation unit is an AND gate, and the second logic operation unit is a NAND gate.

3. The control device according to claim 1, wherein the first adjustment unit comprises:

a first transistor, having a first end, a second end and a third end, wherein the first end receives the first logic signal, and the second end generates the first adjustment signal;

a first resistor, having a first end coupled with the second end of the first transistor, and a second end coupled with a ground terminal;

a second resistor, having a first end coupled with the third end of the first transistor, and a second end coupled with the ground terminal; and a first diode, having an anode terminal coupled with the third end of the first transistor, and a cathode terminal coupled with the second end of the first transistor.

4. The control device according to claim 1, wherein the second adjustment unit comprises:

a second transistor, having a first end, a second end and a third end, wherein the first end receives the second logic signal, and the second end generates the second adjustment signal;

a third resistor, having a first end coupled with the second end of the second transistor, and a second end coupled with a ground terminal;

a fourth resistor, having a first end coupled with the third end of the second transistor, and a second end coupled with the ground terminal; and a second diode, having an anode terminal coupled with the third end of the second transistor, and a cathode terminal coupled with the second end of the second transistor.

5. A light source device, comprising:

a first logic operation unit, for receiving a first enable signal and a second enable signal to generate a first logic signal;

a first adjustment unit, coupled with the first logic operation unit, for receiving the first logic signal, and generating a first adjustment signal according to the first logic signal;

a first control unit, coupled with the first adjustment unit, for receiving the first enable signal and the first adjustment signal, and generating a first control signal according to the first enable signal and the first adjustment signal;

a first light-emitting diode, having an anode terminal for receiving an operating voltage, and a cathode terminal for receiving a first control signal;

a second logic operation unit, for receiving the first enable signal and the second enable signal to generate a second logic signal, wherein the first and second logic signals are complementary;

a second adjustment unit, coupled with the second logic operation unit, for receiving the second logic signal, and generating a second adjustment signal according to the second logic signal; and a second control unit, coupled with the second adjustment unit, for receiving the second enable signal and the second adjustment signal, and generating a second control signal according to the second enable signal and the second adjustment signal;

a second light-emitting diode, having an anode terminal for receiving an operating voltage, and a cathode terminal for receiving the second control signal.

6. The light source device according to claim 5, wherein the first logic operation unit is an AND gate, and the second logic operation unit is a NAND gate.

7. The light source device according to claim 5, wherein the first adjustment unit comprises:

a first transistor, having a first end, a second end and a third end, wherein the first end receives the first logic signal, and the second end generates the first adjustment signal;

a first resistor, having a first end coupled with the second end of the first transistor, and a second end coupled with a ground terminal;

a second resistor, having a first end coupled with the third end of the first transistor, and a second end coupled with the ground terminal; and a first diode, having an anode terminal coupled with the third end of the first transistor, and a cathode terminal coupled with the second end of the first transistor.

8. The light source device according to claim 5, wherein the second adjustment unit comprises:

a second transistor, having a first end, a second end and a third end, wherein the first end receives the second logic signal, and the second end generates the second adjustment signal;

a third resistor, having a first end coupled with the second end of the second transistor, and a second end coupled with a ground terminal;

a fourth resistor, having a first end coupled with the third end of the second transistor, and a second end coupled with the ground terminal; and a second diode, having an anode terminal coupled with the third end of the second transistor, and a cathode terminal coupled with the second end of the second transistor.

9. Light brightness and mixing control logic for two light emitting diodes (LEDs), the control logic comprising:

a pair of enable signal lines, each line carrying either a first logic value or a second logic value, wherein the first logic value is operative to enable a corresponding one of the two LEDs to emit light, and the second logic value is operative to disable the corresponding LED from emitting light; and resistor circuits coupled to the enable signal lines, the resistor circuits operative to provide selectable resistance values to control the brightness of the LEDs;

wherein:

when neither signal line carries the first logic value, neither LED is operative to emit light;

when both signal lines carry the first logic value, both LEDs are operative to emit light, each in accordance with a corresponding first selected resistance value; and when only one of the signal lines carries the first logic value, only the corresponding LED is operative to emit light, and in accordance with a corresponding second selected resistance value.

10. The control logic of claim 9, wherein:

the two LEDs comprise a first LED and a second LED;

the brightness of the first LED is greater for the second selected resistance value than for the first selected resistance value; and the brightness of the second LED is greater for the first selected resistance value than for the second selected resistance value.

11. The control logic of claim 9, wherein:

the two LEDs comprise a first LED and a second LED;

the first selected resistance value corresponding to the first LED is greater than the second selected resistance value corresponding to the first LED; and the first selected resistance value corresponding to the second LED is less than the second selected resistance value corresponding to the first LED.

12. The control logic of claim 9, wherein the resistor circuits comprise a first resistor circuit control to control a first LED and a second resistor circuit to control a second LED.

13. The control logic of claim 12, wherein each resistor circuit comprises a first resistor and a second resistor.

14. The control logic of claim 13, wherein the first and second resistors are arranged in parallel with each other.

15. The control logic of claim 14, wherein each resistor circuit further comprises a transistor.

16. The control logic of claim 15, wherein for each resistor circuit, the first resistor is in series with the transistor.

17. The control logic of claim 16, wherein for each resistor circuit, the second resistor is in parallel with the series arrangement of the transistor and the first resistor.

18. The control logic of claim 17, further comprising first and second binary logic operation units, each of the binary logic operation units receiving the enable signal lines as inputs, the first binary logic operation unit producing an output that feeds the transistor of the first resistor control circuit, the second binary logic operation unit producing an output that feeds the transistor of the second resistor control circuit.

19. The control logic of claim 18, wherein the first and second binary logic operation units generate outputs that are complementary to each other.

20. The control logic of claim 19, wherein the first logic operation unit is an AND gate, and the second logic operation unit is a NAND gate.

* * * * *